US011425504B2

(12) United States Patent
Zhang et al.

(10) Patent No.: US 11,425,504 B2
(45) Date of Patent: Aug. 23, 2022

(54) ACOUSTIC MODULE AND ELECTRONIC PRODUCT

(71) Applicant: Goertek Inc., Shandong (CN)

(72) Inventors: Qingyi Zhang, Shandong (CN); Yuesheng Ma, Shandong (CN); Yingjun Lun, Shandong (CN)

(73) Assignee: Goertek Inc., Weifang (CN)

( * ) Notice: Subject to any disclaimer, the term of this patent is extended or adjusted under 35 U.S.C. 154(b) by 0 days.

(21) Appl. No.: 17/289,811

(22) PCT Filed: Dec. 20, 2018

(86) PCT No.: PCT/CN2018/122261

§ 371 (c)(1),
(2) Date: Apr. 29, 2021

(87) PCT Pub. No.: WO2020/087700

PCT Pub. Date: May 7, 2020

(65) Prior Publication Data

US 2021/0400392 A1 Dec. 23, 2021

(30) Foreign Application Priority Data

Nov. 1, 2018 (CN) ..... 201811297295.8

(51) Int. Cl.
*H04R 9/02* (2006.01)
*H04R 1/34* (2006.01)
(Continued)

(52) U.S. Cl.
CPC ..... *H04R 9/02* (2013.01); *H04R 1/222* (2013.01); *H04R 1/342* (2013.01); *H04R 1/38* (2013.01);
(Continued)

(58) Field of Classification Search
CPC ..... H04R 1/222; H04R 1/342; H04R 1/38; H04R 1/406; H04R 19/04; H04R 25/402; H04R 25/48; H04R 2400/11; H04R 9/02
See application file for complete search history.

(56) References Cited

U.S. PATENT DOCUMENTS 4,142,072 A * 2/1979 Berland ..... H04R 25/48 381/313
5,848,172 A * 12/1998 Allen ..... H04R 1/406 381/356
(Continued)

FOREIGN PATENT DOCUMENTS

CN 202261712 U 5/2012
CN 203086648 U 7/2013
(Continued)

*Primary Examiner* — Huyen D Le
(74) *Attorney, Agent, or Firm* — Baker Botts, LLP

(57) ABSTRACT

Disclosed are an acoustic module and an electronic product. The acoustic module comprises: a module housing, comprising an upper housing and a lower housing, wherein the upper housing of the module has a side wall and a top wall, the side wall has a through hole thereon, a distance between an upper edge of the through hole and the top wall is greater than or equal to one half of an overall height of the side wall, and the upper housing is capable of being fastened onto the lower housing; a fixing member; and a microphone; wherein the fixing member is fastened and fixed in the upper housing, the fixing member is configured to fix the microphone on an inner surface of the top wall, and the fixing member has a sound channel formed therein through which the microphone and the through hole are connected and are in communication.

8 Claims, 5 Drawing Sheets

(51) Int. Cl.
*H04R 1/22* (2006.01)
*H04R 1/40* (2006.01)
*H04R 1/38* (2006.01)

(52) U.S. Cl.
CPC ..... *H04R 1/406* (2013.01); *H04R 2400/11* (2013.01)

(56) References Cited

U.S. PATENT DOCUMENTS 6,151,399 A * 11/2000 Killion ..... H04R 1/38
381/313
7,233,679 B2 * 6/2007 Muthuswamy ..... H04R 19/04
381/174

FOREIGN PATENT DOCUMENTS

CN 104821972 A 8/2015
CN 108494919 A 9/2018

* cited by examiner

ACOUSTIC MODULE AND ELECTRONIC PRODUCT

CROSS-REFERENCE TO RELATED APPLICATIONS

This application is a National Stage of International Application No. PCT/CN2018/122261, filed on Dec. 20, 2018, which claims priority to Chinese Patent Application No. 201811297295.8, filed on Nov. 1, 2018, both of which are hereby incorporated by reference in their entireties.

TECHNICAL FIELD

The invention belongs to the technical field of electronic products, and specifically relates to an acoustic module and an electronic product.

BACKGROUND

In recent years, consumer electronic products have developed rapidly, and the electronic devices such as smart phones and VR devices have been recognized by consumers and have been widely used. Consumer electronic products have a trend of becoming thinner and lighter, and the thicknesses of mobile phones, tablet computers, or the like are becoming thinner and thinner. In addition, consumers also set higher demands for the aesthetic appearance of the electronic products.

In order to meet the requirement of appearance design, those skilled in the art need to design components in the electronic product in a more compact manner, and also need to arrange the components related to product appearance in a predetermined appropriate position. Take an acoustic module of the electronic product as an example, the acoustic module is typically used to convert the sound signal into sound and is an important accessory for the electronic product. The housing of the electronic product is usually provided with a sound emission hole for the sound to be transmitted, and the acoustic module is usually located at a position close to the sound emission hole of the housing of the electronic product.

In an improved technical solution, a microphone is also integrated on the acoustic module. Correspondingly, the housing of the electronic product needs to be provided with a sound receiving hole for the microphone to receive sound. In this case, the microphone needs to be at a position corresponding to the sound receiving hole. However, the sound emission position and the sound receiving position of an existing integrated acoustic module cannot meet the requirements on the positions of the sound emission hole and the sound receiving hole on the housing of the electronic product. If there is no positional correspondence between the sound emission and receiving positions of the acoustic module, it will have considerable adverse impact on the acoustic performance of the acoustic module.

SUMMARY

An object of the present invention is to provide a new technical solution for the acoustic module.

According to the first aspect of the present invention, there is provided an acoustic module comprising:

a module housing comprising an upper housing and a lower housing, wherein the upper housing of the module has a side wall and a top wall, the side wall has a through hole formed thereon, a distance between an upper edge of the through hole and the top wall is greater than or equal to one half of an overall height of the side wall, and the upper housing is configured to be capable of being fastened onto the low housing;

a fixing member: and a microphone;

wherein the fixing member is fastened and fixed in the upper housing, the fixing member is configured to fix the microphone on an inner surface of the top wall, the fixing member has a sound channel formed therein, through which sound channel the microphone and the through hole are connected and are in communication with each other.

Optionally, a containing area is formed in the fixing member, the microphone is disposed in the containing area, and the sound channel is in communication with the containing area.

Optionally, the containing area has one open side, the one open side of the containing area is fastened onto the inner surface of the top wall, and a bottom surface of the microphone is in contact with the inner surface of the top wall.

Optionally, the fixing member is provided with a separation plate, the separation plate has a connecting hole formed therein, one side of the separation plate is configured to enclose and constitute the containing area, the other side of the separation plate is configured to enclose and constitute the sound channel, and through which connecting, hole the containing area and the sound channel are in communication with each other.

Optionally, a sound receiving surface of the microphone faces the connecting hole.

Optionally, a normal line of the sound receiving surface of the microphone is perpendicular to the inner surface of the top wall, an extension direction of the sound channel is parallel to the inner surface of the top wall, and the sound receiving surface of the microphone faces away from the inner surface of the top wall.

Optionally, a protective film is provided on the sound receiving surface of the microphone.

Optionally, the acoustic module further comprises a sound generating component which is disposed in the module housing, a sound emission hole is formed as a perforation in the side wall, the sound emission hole and the through hole are arranged side by side, and the sound emission hole is configured to allow sound generated by the sound generating component to be transmitted from the sound emission hole.

Optionally, the microphone is provided with a flexible circuit board connected thereto.

The present invention also provides an electronic product comprising:

the acoustic module as described above; and a product housing in which the acoustic module is fixedly disposed;

wherein the product housing has a sound receiving opening formed thereon, the sound receiving opening and the through hole are in communication with each other and are positioned in alignment with each other.

According to an embodiment of the present disclosure, a positional correspondence may be more easily formed between the sound receiving position of the microphone and the sound receiving hole position on the electronic product.

Other features and advantages of the invention will become clear from the following detailed description of exemplary embodiments of the invention with reference to the drawings.

BRIEF DESCRIPTION OF THE DRAWINGS

The drawings incorporated in the specification and constituting a part of the specification show embodiments of the present invention, and together with the description thereof, serve to explain the principle of the present invention.

DETAILED DESCRIPTION

Figure 1:
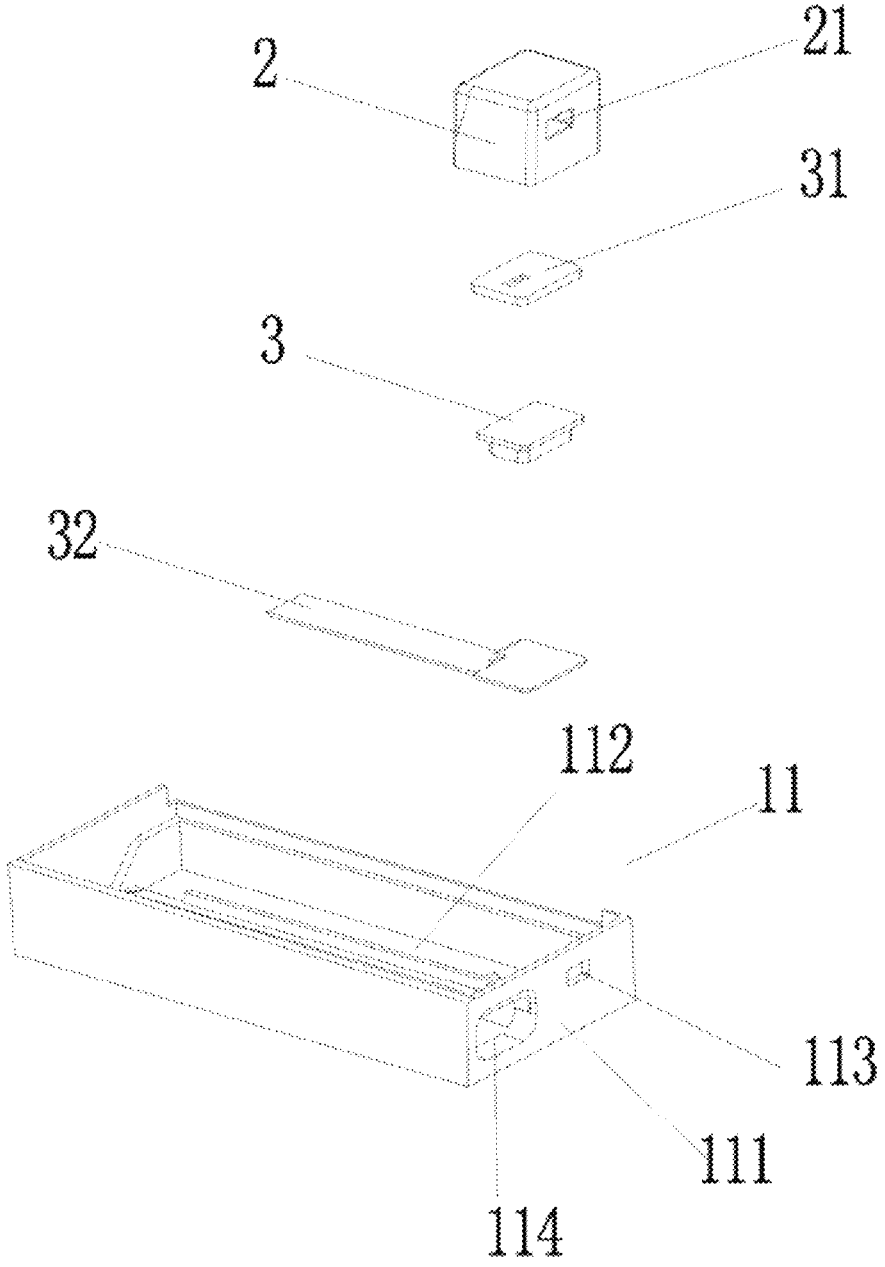
FIG. 1 is an exploded view of some parts of the acoustic module provided by the present invention.

Various exemplary embodiments of the invention will now be described in detail with reference to the drawings. It should be noted that: unless specifically stated otherwise, the relative arrangement of components and steps, numerical expressions, and numerical values set forth in these embodiments do not limit the scope of the invention.

The following description of at least one exemplary embodiment is actually merely illustrative, and in no way serves as any limitation on the invention and its application or use.

The technologies, methods, and devices known to those of ordinary skill in relevant fields may not be discussed in detail, but where appropriate, the technologies, methods, and devices should be regarded as part of the specification.

In all examples shown and discussed herein, any specific values should be interpreted as exemplary only and not as limitations. Therefore, other examples of the exemplary embodiment may have different values.

It should be noted that similar reference numerals and letters indicate similar items in the following figures, so once an item is defined in one figure, it does not need to be discussed further in subsequent figures.

Figure 2:
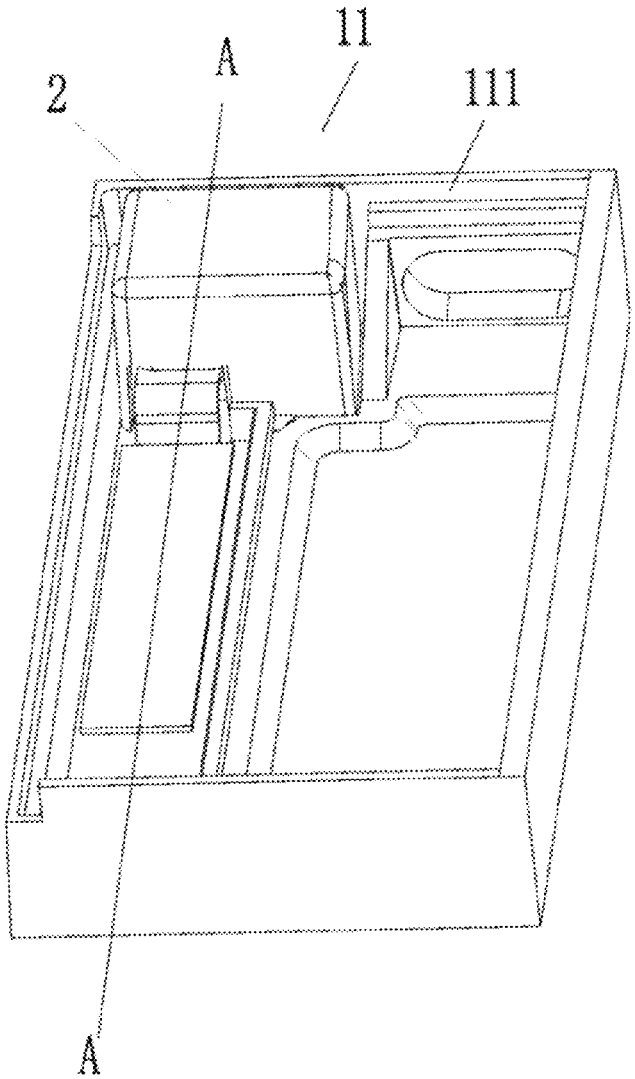
FIG. 2 is an assembly isometric view of some parts of the acoustic module provided by the present invention.

The present invention provides an improved acoustic module. As shown in FIGS. 1 and 2, the acoustic module at least includes: a module housing, a fixing member 2 and a microphone 3. The module housing comprising an upper housing 11 and a lower housing, wherein the upper housing 11 may be fastened onto the lower housing to form a containing area for accommodating the fixing member 2, the microphone 3 and other components.

Figure 3:
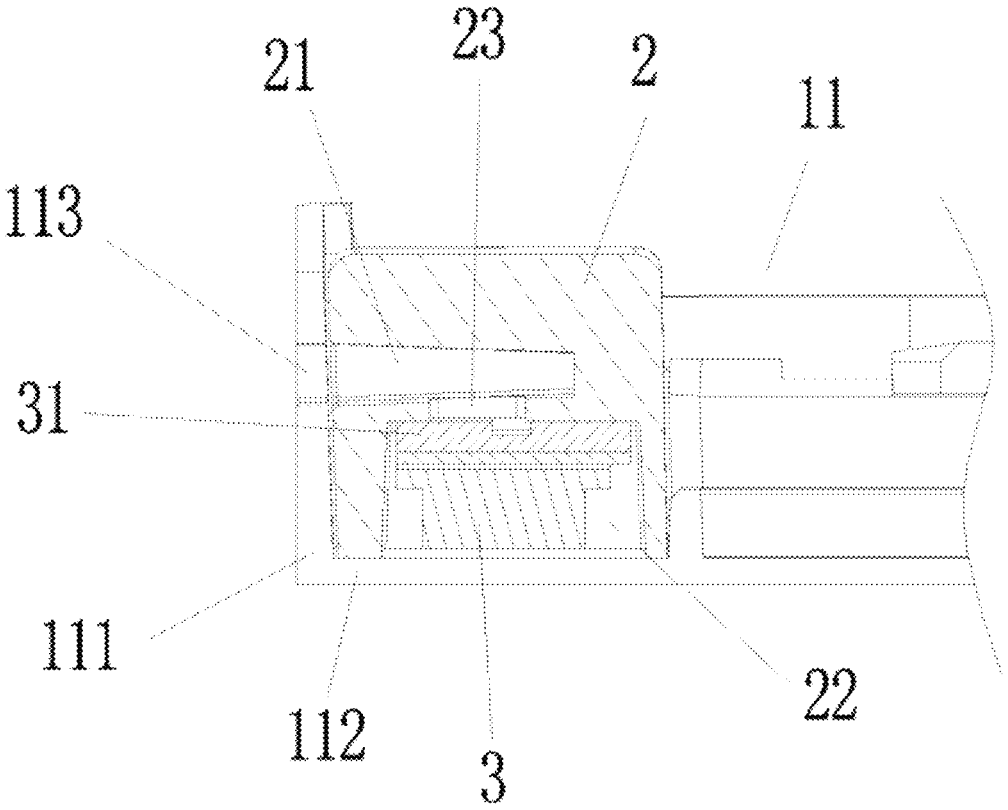
FIG. 3 is a side cross-sectional view at line A-A in FIG. 2.
Figure 4:
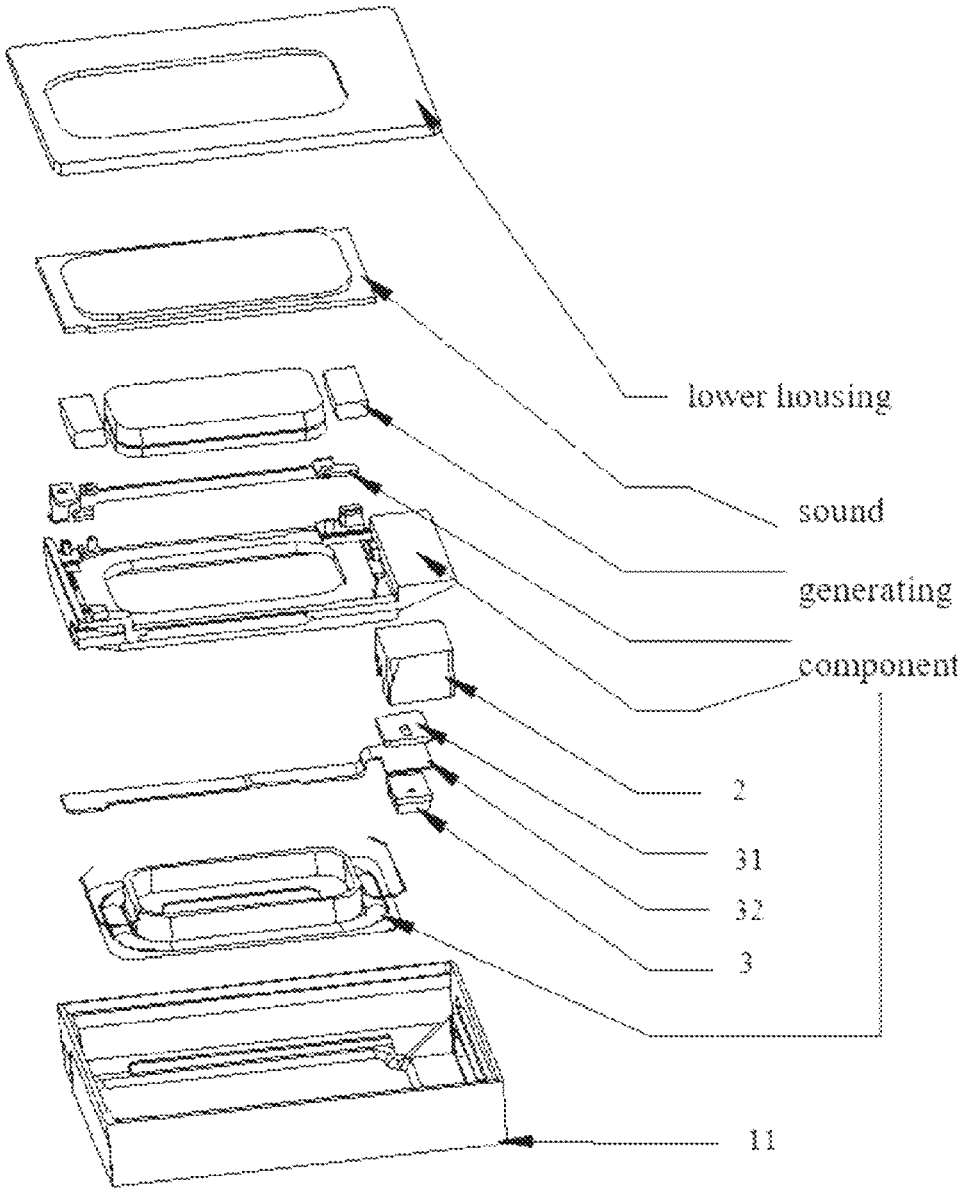
FIG. 4 is an exploded view of the acoustic module provided by the present invention.
Figure 5:
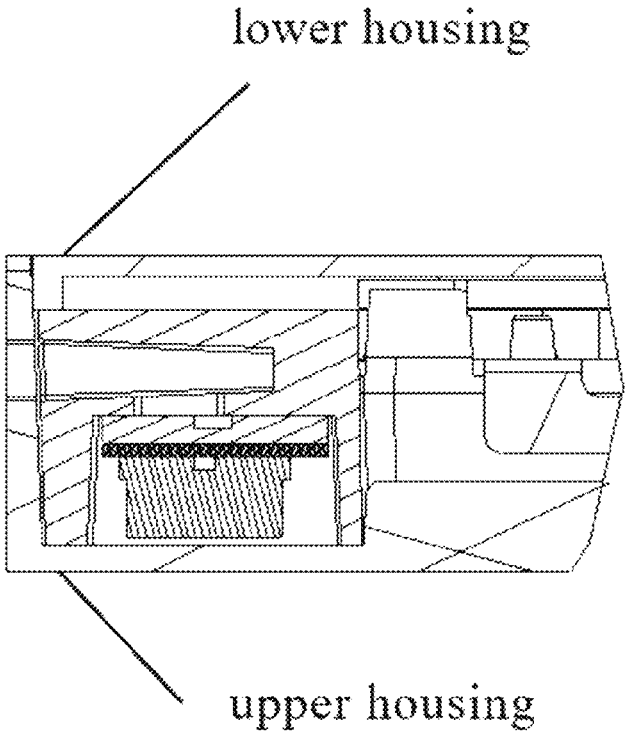
FIG. 5 is a cross-sectional view of the acoustic module provided by the present invention.

As shown in FIGS. 1-3, the upper housing 11 has a side wall 111 and a top wall 112, and a through hole 113 is formed on the side wall 111. The through hole 113 may be used as a sound receiving hole of the microphone 3. A distance between an upper edge of the through hole 113 and the top wall 112 is greater than or equal to one half of an overall height of the side wall 111. The upper edge of the through hole 113 in the present invention refers to an edge of the through hole 113 close to the top wall 112. In the technical solution of the present invention, the through hole 113 is located at a position on the side wall 111 relatively distal from the top wall 112, and as shown in FIGS. 1 and 3, the distance between the upper edge of the through hole 113 and the top wall 112 is greater than one half of the overall height of the side wall 111.

As shown in FIG. 3, the fixing member 2 is fastened in the upper housing 11, and the fixing member 2 is configured to fix the microphone 3 on the inner surface of the top wall 112. The microphone 3 can be sandwiched between the fixing member 2 and the top wall 112. Further, a sound channel 21 is formed in the fixing member 2. Through the sound channel 21, the microphone 3 and the through hole 113 are connected and are in communication with each other. The microphone 3 may be connected to the through hole 113 through the sound channel 21 so as to receive sound from the outside of the through hole 113.

In practical applications of the acoustic module, the lower housing is usually located at the lower side in the gravity direction, and the upper housing is located above the lower housing. That is, the inner surface of the top wall of the upper housing faces downward. By providing the acoustic module of the present invention with the fixing member, the microphone may be conveniently fixed upward at a position close to the inner surface of the top wall. Further, as the above-mentioned sound channel is formed in the fixing member, in order to ensure that the sound may pass through the sound channel smoothly, the sound channel must take up a certain volume of space, because it is necessary to have an unhindered and smooth space for air and sound waves to flow. As shown in FIG. 3, since the microphone 3 is close to the top wall 112, the sound channel 21 may be conveniently connected to the through hole 113 distal from the top wall 112 under the premise of meeting the space requirement for the unhindered sound transmission, in practical applications, the through hole 113 is distal from the top wall 112, that is, closer to the bottom of the lower housing; the through hole 113 is on the side wall 111, closer to the bottom of the module housing.

The approach to design the present invention enables the through hole on the acoustic module for receiving sound to be adapted to the relatively lower sound receiving hole provided on the electronic product. The through hole may be connected with the sound receiving hole on the electronic product, and the microphone may smoothly receive the sound through the through hole and the sound receiving hole with the aid of the sound channel formed by the fixing member. The acoustic module provided by the present invention may better adapt to the position of the sound receiving hole required on the electronic product, reduce the problem of the misalignment of the through hole and the sound receiving hole, or avoid the problem of poor sound receiving caused by the microphone in order to receive the sound from the sound receiving hole that has been determined.

Without using the technical solution provided by the present invention, it is difficult to arrange the microphone at a position close to the top wall of the upper housing. If the microphone is in a middle position in the height direction of the module housing, or is located a position near the bottom of the lower housing, it is difficult for the microphone to smoothly receive sound from the through hole far from the top wall of the upper housing.

Preferably, the width of the through hole itself in the height direction of the side wall is less than or equal to one third of the overall height of the side wall. If the width of the through hole is too wide, on one hand, it may adversely impact the assembly position of the microphone and reduce the assembly space that may accommodate the microphone, and on the other hand, the through hole may not match the aperture on the electronic product for the sound receiving.

Optionally, as shown in FIG. 3, a containing area 22 is formed in the fixing member 2, and the microphone 3 is disposed in the containing area 22. The accommodating area 22 forms an enclosure for the microphone 3, thereby functions to position and fix the microphone 3. The sound channel 21 is connected to the containing area 22 so as to introduce the external sounds into the containing area 22 for the microphone 3 to pick up. Preferably, the shape of the containing area 22 matches with the shape of the microphone 3, such that the microphone 3 may be positioned more accurately.

Preferably, as shown in FIG. 3, one side of the containing area 22 is open, while the other sides are provided with a side wall 111 to form an enclosure for the microphone 3. The microphone 3 can be loaded into the containing area 22 from the one open side of the containing area 22. The fixing member 2 fastens the one open side of the containing area 22 onto the inner surface of the top wall 112, and the inner surface of the top wall 112 and the containing area 22 together confine the position of the microphone 3. The bottom surface of the microphone may directly contact the inner surface of the top wall. With this design approach, the microphone can be directly attached to the inner surface of the top wall, leaving as much space as possible for the sound channel. Moreover, the positioning accuracy of the microphone is higher by using a way that the containing area and the inner surface of the top wall cooperate to locate the microphone.

Optionally, as shown in FIG. 3, the fixing member 2 has a separation plate which is used to form the containing area 22 and the sound channel 21. One side of the separation plate is configured to enclose and constitute the containing area 22, and the other side of the separation plate is configured to enclose and constitute the sound channel 21. The sound channel 21 may be completely formed in the fixing member 2. As shown FIGS. 1 and 2, the fixing member 2 may be of an approximate cubic structure, and some parts of the fixing member 2 are hollowed-out for forming the sound channel 21 and the containing area 22. The separation plate is located in the middle of the hollowed-out area in the fixing member 2 and is used to separate the sound channel 21 from the containing area 22. A connecting hole 23 is formed in the separation plate, and the connecting, hole 23 connects the containing area 22 with the sound channel 21. The sound introduced into the sound channel 21 from the through hole 113 may be further introduced into the containing area 22 from the connecting hole 23. The design of the fixing member using the separation plate can better confine the shape of the containing area, thereby improving the positioning accuracy of the microphone. Moreover, the separation plate also more conveniently confines the space of the sound channel.

Optionally, the microphone may be a MEMS micro microphone. The microphone usually has a micro-hole for receiving sound, and the micro-hole is usually on one side surface of the microphone device, which surface is the sound receiving surface of the microphone. Preferably, the sound receiving surface of the microphone faces the connecting hole, to facilitate reception of sound.

Optionally, as shown in FIG. 3, the normal line of the sound receiving surface of the microphone 3 is perpendicular to the inner surface of the top wall 112. The extension direction of the sound channel 21 may be parallel to the inner surface of the top wall 112. Further, the sound receiving surface faces away from the inner surface of the top wall 112. With this design, the microphone may receive the sound from the through hole more smoothly. Regarding the extension direction of the sound channel, this design enables the acoustic module to better adapt to the needs of the side sound receiving and side sound emission of the electronic product. The acoustic module may be of a flat structure as a whole, with large areas for both the top wall of the upper housing, and the bottom of the lower housing corresponding to the top wall, and a small height of the side wall. The sound channel extends for a distance along a direction parallel to the top wall, and then is transmitted to the sound receiving surface of the microphone parallel to the top wall. As such, the flat space in the acoustic module is efficiently utilized.

Optionally, as shown in FIGS. 1 and 3, a protective film 31 may be provided on the sound receiving surface of the microphone 3. The protective film 31 is used to protect the sound receiving surface and may allow air flow and air vibration to pass through, and can block foreign objects from entering the sound channel 21, to prevent them from damaging the microphone 3.

The acoustic module may further comprise a sound generating component which is disposed in the module housing and the fixing member and the microphone are arranged beside the sound generating component. A sound emission hole is formed as a perforation in the side wall of the upper housing. The sound emission hole is for the sound generated by the sound generating component to transmit out. Preferably, as shown in FIG. 1, the sound emission hole 114 and the through hole 113 are arranged side by side. The appearance of the electronic product often requires the apertures for sound emission and sound receiving to be arranged side by side to maintain the beauty. The through hole and sound emission hole of the acoustic module are arranged side by side, to meet the requirements of matching the positions of the apertures on the housing of the electronic product.

Optionally, as shown in FIG. 1, the microphone 3 may be provided with a flexible circuit board 32 connected thereto, and the flexible circuit board 32 is used to introduce the acoustic signal generated by the microphone 3 into the control chip or other control device of the electronic product. In the embodiment where the fixing member 2 is formed with the containing area 22, the flexible circuit board 32 may protrude between the fixing member 2 and the inner surface of the top wall 112. Alternatively, the fixing member 2 may be specially formed with a channel structure through which the flexible circuit board 32 extends out.

The present invention also provides an electronic product, which may be a is phone or a tablet, etc., and includes product housing and the acoustic module as described above. The acoustic module is fixedly arranged in the product housing, and a sound receiving opening is formed on the product housing. The through hole on the acoustic module and the sound receiving opening are in communication with each other and are positioned in alignment with each other. The sound receiving opening may be arranged at a position of the side wall of the product housing close to the bottom. In this case, the acoustic module provided by the present invention may still provide the through hole at a position corresponding to the sound receiving opening while ensuring the smoothness of the sound receiving.

Further, a sound emission opening may also be formed on the product housing, and the sound emission opening corresponds to the sound emission hole on the acoustic module, and is used to for the sound generating component to transmit sound from the sound emission hole.

Although some specific embodiments of the present invention have been described in detail through examples, those skilled in the art should understand that the examples are only for illustration rather than limiting the scope of the present invention. It should be understood by a person skilled in the art that the above embodiments can be modified without departing from the scope and spirit of the present invention. The scope of the present invention is defined by the attached.

The invention claimed is:

1. An acoustic module, comprising:

a module housing, comprising an upper housing and a lower housing, wherein the upper housing of the module has a side wall and a top wall, the side wall has a through hole formed thereon, a distance between an upper edge of the through hole and the top wall is greater than or equal to one half of an overall height of the side wall, and the upper housing is configured to be fastened onto the lower housing;

a fixing member; and a microphone;

wherein the fixing member is fastened and fixed in the upper housing, the fixing member is configured to fix the microphone on an inner surface of the top wall, and the fixing member has a sound channel formed therein, through which sound channel the microphone and the through hole are connected and are in communication with each other, wherein a containing area is formed in the fixing member, the microphone is disposed in the containing area, and the sound channel is in communication with the containing area, wherein the containing area has one open side, the one open side of the containing area is fastened onto the inner surface of the top wall, and a bottom surface of the microphone is in contact with the inner surface of the top wall.

2. The acoustic module of claim 1, wherein the fixing member is provided with a separation plate, the separation plate has a connecting hole formed therein, a first side of the separation plate is configured to enclose and constitute the containing area, a second side of the separation plate is configured to enclose and constitute the sound channel, and through which connecting hole the containing area and the sound channel are in communication with each other.

3. The acoustic module of claim 2, wherein a sound receiving surface of the microphone faces the connecting hole.

4. The acoustic module of claim 1, wherein a normal line of a sound receiving surface of the microphone is perpendicular to the inner surface of the top wall, an extension direction of the sound channel is parallel to the inner surface of the top wall, and the sound receiving surface of the microphone faces away from the inner surface of the top wall.

5. The acoustic module of claim 1, wherein a protective film is provided on a sound receiving surface of the microphone.

6. The acoustic module of claim 1, further comprising a sound generating component which is disposed in the module housing, a sound emission hole is formed as a perforation in the side wall, the sound emission hole and the through hole are arranged side by side, and the sound emission hole is configured to allow sound generated by the sound generating component to be transmitted from the sound emission hole.

7. The acoustic module of claim 1, wherein the microphone is provided with a flexible circuit board connected thereto.

8. An electronic product, comprising:

an acoustic module of claim 1; and a product housing in which the acoustic module is fixedly disposed;

wherein the product housing has a sound receiving opening formed thereon, the sound receiving opening and the through hole are in communication with each other and are positioned in alignment with each other.

* * * * *